US005732895A

United States Patent [19]

Karra

[11] Patent Number: 5,732,895

[45] Date of Patent: Mar. 31, 1998

[54] CONICAL CRUSHER HAVING FLUID BELLOW SUPPORT ASSEMBLIES

[75] Inventor: Vijia Kumar Karra, Franklin, Wis.

[73] Assignee: Nordberg, Incorporated, Milwaukee, Wis.

[21] Appl. No.: 658,650

[22] Filed: Jun. 5, 1996

[51] Int. Cl.[6] ..... B02C 2/02

[52] U.S. Cl. ..... 241/207; 241/215

[58] Field of Search ..... 241/207, 208, 241/214, 215, 216, 293, 37

[56] References Cited

U.S. PATENT DOCUMENTS

| | | | |
|---|---|---|---|
| 1,083,283 | 1/1914 | Kelly | 241/207 |
| 2,224,542 | 12/1940 | Gruender et al. | 241/216 |
| 3,080,126 | 3/1963 | Kueneman | 241/216 |
| 3,604,640 | 9/1971 | Webster | 241/215 |
| 4,147,309 | 4/1979 | Vroom | 241/215 |
| 4,179,076 | 12/1979 | Barrot et al. | 241/216 |
| 4,391,414 | 7/1983 | Reiter | 241/216 X |

FOREIGN PATENT DOCUMENTS

| | | | |
|---|---|---|---|
| 425642 | 2/1975 | U.S.S.R. | 241/214 |

*Primary Examiner*—John M. Husar
*Attorney, Agent, or Firm*—Foley & Larnder

[57] ABSTRACT

A conical crusher having a rigidly supported outer frusto-conically shaped crushing member and an inner conical crushing member supported on a wobble mechanism which is in turn supported by air bellows. The air pressure in the air bellows is regulated to adjust the spacing between the inner and outer crushing members, and therefore the particle size of the crushed material. The inner and outer crushing members are readily replaceable.

23 Claims, 4 Drawing Sheets

P
138
140
66
22
136
14

116
118
114
16
14
12
120
20
22
108
122
10
34
38
32
106
36
30
24
26
50
104
28
36
58
124
21
14
18
76
78
80
74
12
120
112
16
84
82
70
72
68
COMP.

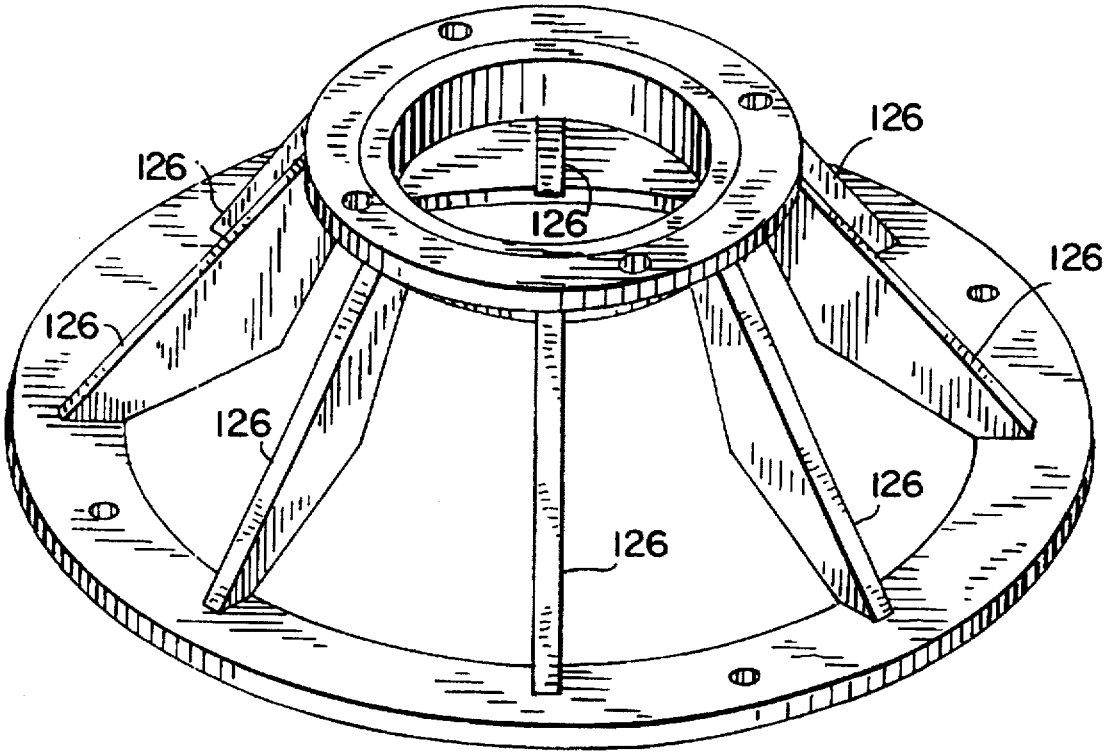
FIG. 4
FIG. 5
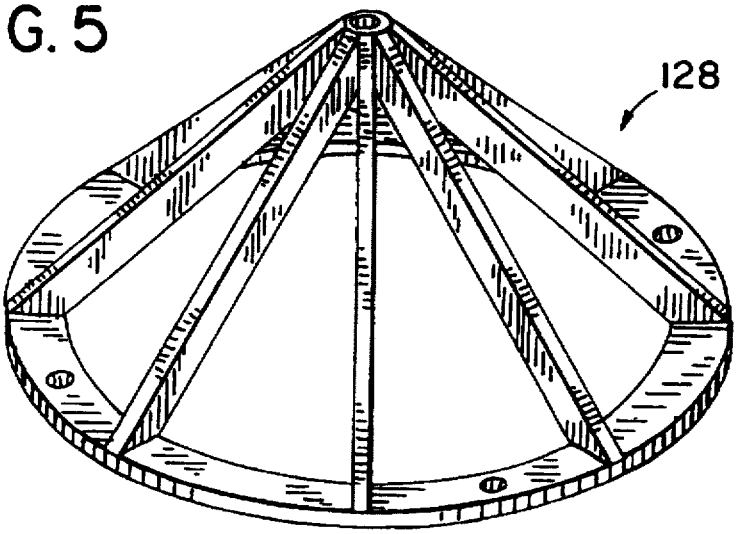

CONICAL CRUSHER HAVING FLUID BELLOW SUPPORT ASSEMBLIES

CROSS REFERENCE TO RELATED APPLICATIONS

The present application is related to U.S. application Ser. No. 08/658,353 entitled "A Conical Crusher Having a single Piece Inner Crushing Member," now pending and U.S. application Ser. No. 08/658,366, entitled "A Conical Crusher Having a Single Piece Outer Crushing Member," now pending both assigned to the Assignee of the present invention and invented by Karra.

FIELD OF THE INVENTION

The present invention generally relates to a conical crusher. More particularly, the present invention relates to a rock crusher of simplified construction and superior operational efficiency. The rock crusher can be used for size reduction of low strength, easy to crush materials such as rocks and minerals and for light duty shaping-type crushing operations.

BACKGROUND OF THE INVENTION

Conical crushers having head assemblies which are caused to gyrate by an eccentric mechanism, driven by various rotary power sources, are commonly available and have been the subject of numerous prior patents. A conical crusher typically has an annular shell and a central hub to which an annular ring is mounted for vertical movement. The crusher bowl and liner are mounted on the annular ring. The head assembly includes a liner which is mounted, for movement through a bearing mechanism, directly to a stationary shaft within the hub. Gyration of the head relative to the bowl assembly is provided by an eccentric mounted for movement about the stationary shaft. With respect to rotation about the shaft, the eccentric is dynamically balanced about its center of rotation by a counter weight. The bowl of the crusher is provided with an upper replaceable liner and the head member is provided with a replaceable mantle.

Alternatively, another type of conical crusher can include a shaft which is moved by a hydraulic piston arrangement attached to the bottom end of the shaft. The bowl liner can be fixed to an outer concentric fixed frame. In both types of cone crushers, the gap between the bowl liner and crushing head can be manipulated to provide particular sized crushed product. Both of these types of rock crushers have proven most satisfactory in heavy-duty crushing operations, particularly when the coacting crushing surfaces, which are subject to wear, are provided with replaceable liners for extending the life of the crusher.

However, for certain crushing and shaping operations, a less robust crusher, of simpler and lighter weight construction and greater operational efficiency, is desirable. For instance, it is not necessary to use a heavy-duty crusher, such as set forth in the above-mentioned patents, for low strength, easy to crush rocks and minerals such as coal and non-metallic minerals, and for light duty shaping type crushing applications. Thus, there is a need for a rock crusher which does not utilize massive support structures. Further, there is a need for a light duty crusher which can be easily adjusted for producing various sizes of crushed materials.

SUMMARY OF THE INVENTION

The present invention relates to a crusher including a main support member, a gyrational mechanism, a crushing member, and a fluid bellow assembly. The gyrational mechanism is supported by the main support member and provides a gyrational motion with respect to the main support member. The crushing member is mechanically coupled to the gyrational mechanism and performs a crushing motion in response to the gyrational motion. The fluid bellow assembly indirectly or directly is secured to the crushing member and to the main support member. The fluid bellow assembly prevents the rotation of the crushing member with respect to the main support member.

The present invention further relates to a crusher including a main support member, a wobble mechanism rotatably coupled to the main support member, a crushing member and an auxiliary support means. The wobble mechanism provides mechanical motion. The crushing member is coupled to receive the mechanical motion and perform a crushing motion in response to the mechanical motion. The auxiliary support means supports the crushing head and allows the crushing head to perform the crushing operation without allowing the crushing member to rotate with respect to the main support member.

The present invention still further relates to a crusher comprising a main frame a crushing member, and a wobble mechanism. The wobble mechanism has a first member, a second member and an adjustable support member. The first member is supported for relative rotation with reference to the second member. The second member is secured to the crushing member. The second member is adjustably spaced from the main frame by the adjustable support member. A spacing between the second member and the main frame can be adjusted to define the size of crushed material provided by the crusher.

It is an object of this invention to provide a crusher, for certain types of crushing and shaping applications, which has fewer parts, is less expensive to assemble, and therefor may be manufactured at a lower cost. It is another object of this invention to provide a crusher, suitable for certain crushing operations, which has improved operational efficiencies, particularly with respect to energy usage and operational maintenance costs.

In accordance with an aspect of the invention, a crusher is provided in which a wobble mechanism, driven by a vertical rotating shaft, causes a conically shaped, downwardly spreading inner crushing member, to wobble within a frustoconically shaped downwardly spreading outer crushing member. Material flowing downwardly between the inner and outer crushing members is crushed therebetween. The wobble mechanism includes a pair of members, a lower one of which is caused to rotate by the driven vertically rotating shaft, and an upper one of which is supported for rotation upon the lower one by a bearing assembly. The top surface of the lower member is in a plane which is not perpendicular to the axis of the vertical shaft. Thus, the upper member, the bottom surface of which rests on the top surface of the lower member, and which is prevented from rotation, will wobble as the lower member rotates.

According to a further aspect of the present invention, a conically shaped downwardly spreading inner crushing member is supported upon a bottom plate which is secured to the top surface of the upper member of the wobble mechanism. A frustoconically shaped downwardly spreading outer crusher member is supported in a fixed position surrounding the inner crushing member. The wobble mechanism, and therefor the inner crushing member, is supported so as to be vertically adjustable with respect to the base of the crusher. By adjusting the vertical position of the inner crushing member, its position with respect to the outer crushing member is adjusted. In a preferred embodiment, the inner crushing member is adjustably supported on the base of the crusher by an air bellow assembly. By regulating the air pressure in the air bellow assembly, the relative height of the inner crushing member with respect to the base of the crusher may be adjusted.

Rotation of the upper member of the wobble mechanism and therefor of the inner crushing member, is advantageously prevented by a second air bellow assembly. The conically shaped inner crushing member and the frustoconically shaped outer crushing member may be supported by spider-like frames when such additional support of the crushing members is found to be desirable, for instance, for heavier duty crushing operations.

BRIEF DESCRIPTION OF THE DRAWINGS

FIG. 4 is a perspective view of an alternative embodiment of the outer crushing member of the conical crusher shown in FIG. 1, which is provided with a support rib cage; and FIG. 5 is a perspective view of a support rib cage for the inner crushing member of the conical crusher shown in FIG. 1.

DETAILED DESCRIPTION OF THE PREFERRED EMBODIMENT

Figure 1:
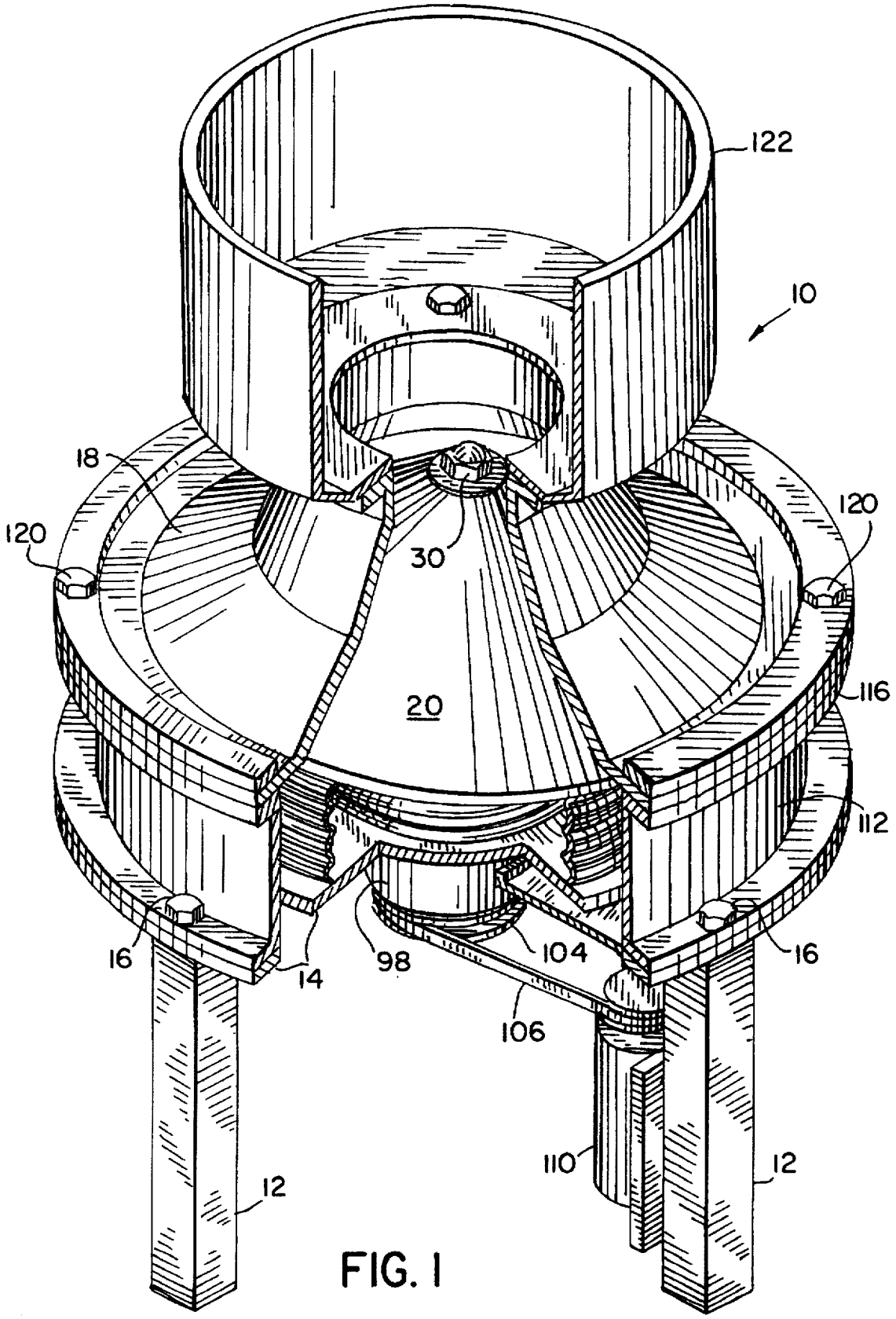
FIG. 1 is a perspective view of a conical crusher constructed in accordance with this invention.
Figures 2, 2A:
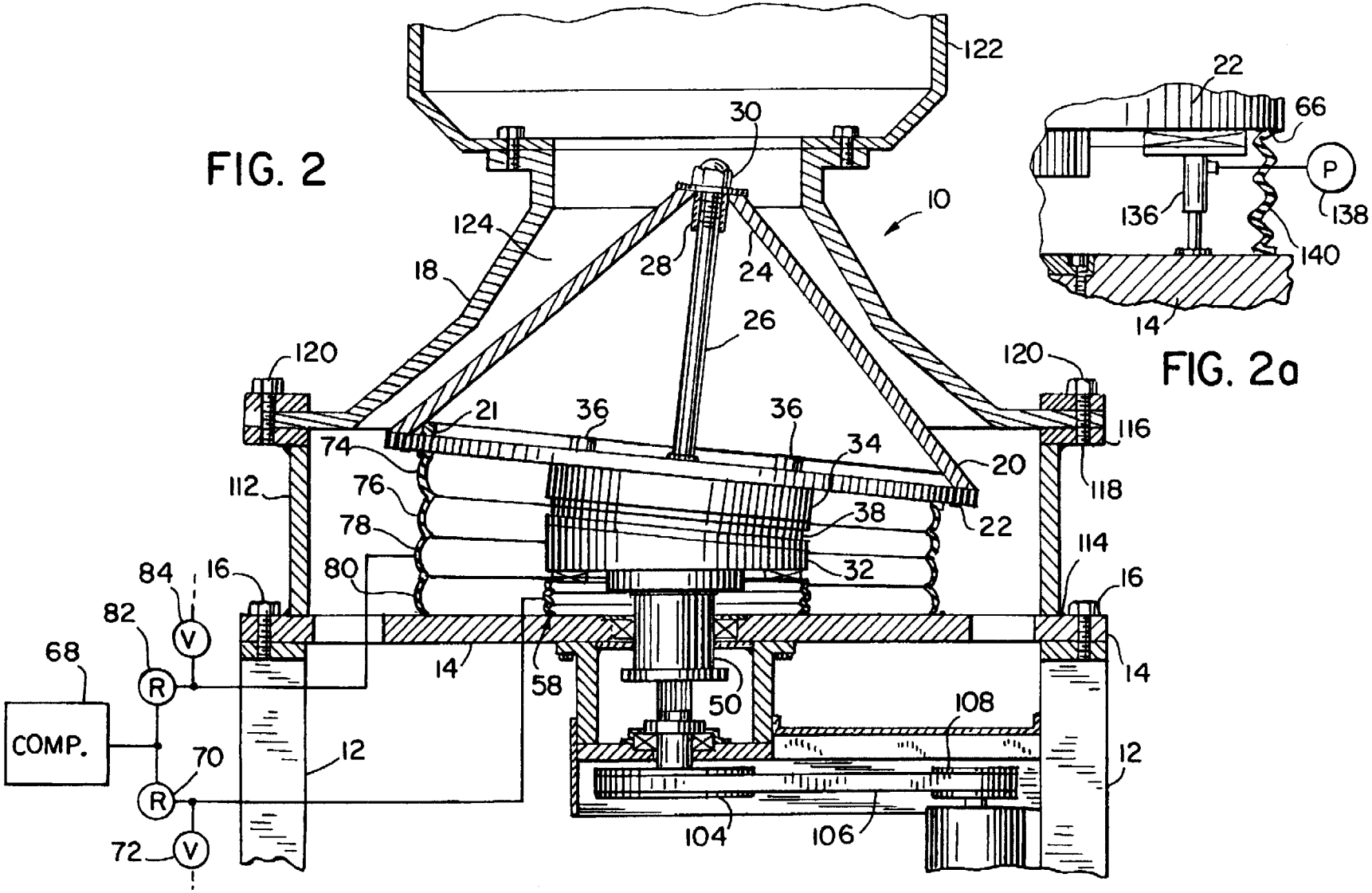
FIG. 2 is a cross-sectional view of the conical crusher of this invention as shown in FIG. 1.
FIG. 2*a* is a partial cross-sectional view of an alternate construction for a portion of the conical crusher as shown in FIG. 2.

Referring to FIGS. 1 and 2, a crushing system or conical crusher 10 in accordance with an exemplary embodiment of the present invention is shown supported on foundation pillars 12. The crusher is assembled on a main support member or bottom plate 14. The bottom plate 14 is secured to the foundation pillars 12 by anchoring means such as bolts 16. While the crusher is shown supported on pillars 12, it may be supported in any other suitable manner, such as on a cylindrical base having opening therein for removal of the crushed material and servicing of the crusher.

The crusher includes a frustoconically shaped downwardly spreading outer crushing member 18 and a conically shaped downwardly spreading inner crushing member 20. The inner crushing member 20, which is commonly referred to as a mantle, is supported along its lower edge on a bottom or a base plate 22. Base plate 22 can include a retaining member or retaining ring 21 to help secure member 20. A hole 24 is provided in the apex of the crushing member 20 through which passes a securing device 26 in the form of a rod which is secured at its lower end to the base plate 22 and is provided with a threaded portion 28 at its upper end. A fastener 30, in the form of a nut, engages the threaded portion 28 and presses on the top edge of the inner crushing member 20 to secure it to the base plate 22. Fastener 30 can be protected by a suitable wearing member disposed over it.

Figure 3:
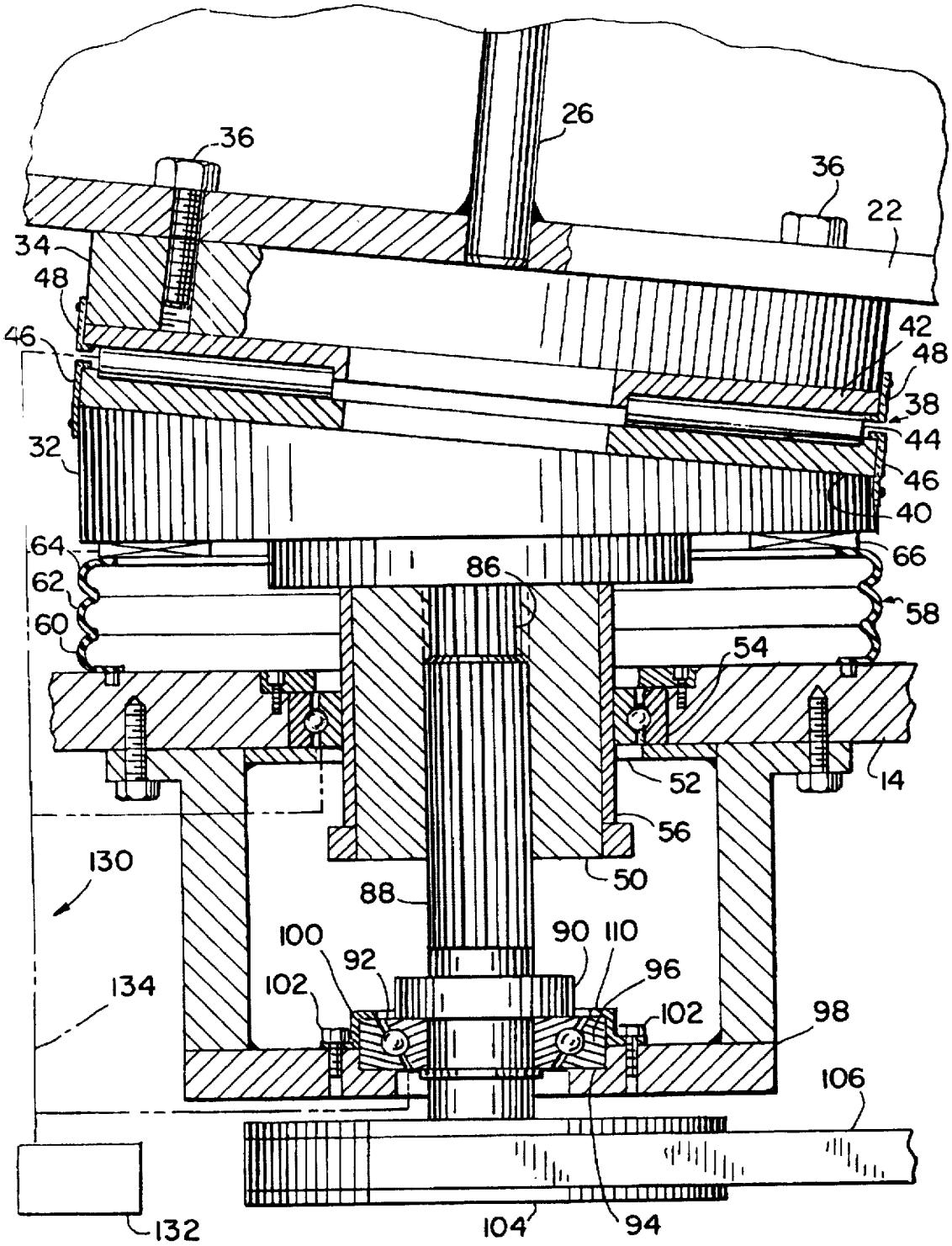
FIG. 3 is an enlarged cross-sectional view of the support and drive mechanism for the inner crushing member of the conical crusher of this invention as shown in FIG. 1.

Referring to FIGS. 2 and 3, the conically shaped inner crushing member 20 is supported on a wobble mechanism which includes a lower cylindrical member 32 and an upper cylindrical member 34. The upper cylindrical member 34 is secured to the base plate 22 by a fastener such as bolts 36. A bearing arrangement 38, shown as radially extending roller bearings, is interposed between the upper surface of lower member 32 and the lower surface of upper member 34 to permit the upper and lower member to rotate with respect to each other. Alternatively, bearing arrangement 38 can be a plurality of vertically disposed rollers located at an outer edge of members 32 and 34. Further still, bearing arrangement 38 can be a vertically disposed sleeve bearing system or a horizontally disposed thrust bearing system.

As shown in FIG. 3, the bearing assembly 38 includes a lower bearing race 40, an upper bearing race 42, and rollers 44. The lower bearing race 40 is secured to lower member 32 by clamps 46, and the upper bearing race 42 is secured to upper member 34 by clamps 48. The lower member 32 is secured to and supported on the upper end of a shaft 50 for rotation therewith. Generally, any mechanism can be used to rotate, gyrate, move or wobble inner crushing member 20 including but not limited to an eccentric mechanism (not shown). The upper surface of the lower member 32 is in a plane which is not perpendicular to the central axis of the shaft 50. Thus, as the shaft 50 rotates, the upper member 34, which is prevented from rotating, as will hereinafter be described, is caused to wobble as alternately a higher and a lower portion of the upper surface of the lower member 32 passes under a fixed location on the upper member 34. The upper surface of the lower member 32 may be located in a plane which is not perpendicular to the central axis of the shaft 50 by forming the lower member 32 as a wedge shaped member, or by welding a uniformly thick lower member 32 to the end of the shaft 50 which has been cut in a plane which is not perpendicular to its central axis.

The shaft 50 passes through an aperture 52 formed in the bottom plate 14 and is supported for rotation therein by a bearing 54. The shaft 50 is surrounded by a cylindrical sleeve 56 which slides vertically with respect to the inner race of the bearing 54. The sleeve 56, which is secured to shaft 50, is formed of a material which will reduce the sliding friction between the inner race of the bearing 54 and shaft 50. The shaft 50, lower member 32 and upper member 34 of the wobble mechanism, as well as the inner crushing member 20, are supported on the bottom plate 14 by a fluid bellow assembly such as air bellow assembly 58 which is illustrated as three ring shaped bellows stacked one on top of the other. The bellows 60, 62 and 64 are secured to each other, and the lower surface of the lower bellow 60 is secured to the bottom plate 14 by securing devices such as pins. A ring like bearing assembly 66 is interposed between the top surface of the bellow 64 and the lower surface of the lower member 32. While not shown in detail, ring-like bearing assembly 66 could be similar in construction to bearing 38, with an upper bearing race secured to the lower surface of lower member 32, and a lower bearing race secured to the top of bellow 66. Bearing 54 can be a horizontally or vertically disposed sleeve bearing, roller bearing or thrust bearing.

The height of the lower member 32 with respect to the bottom plate 14 is adjusted by regulating the air pressure in the ring shaped bellows 60, 62 and 64. As shown in FIG. 2, air may be supplied from a compressor 68 through a regulator 70 to the bellows 60, 62 and 64. Should it be desirable to reduce the air pressure in bellows 60, 62, and 64, air may be discharged through valve 72.

The inner crushing member 20 is prevented from rotating by a fluid bellow assembly shown as a stack of air bellows 74, 76, 78 and 80. The bellows are secured to each other, and the upper surface of bellow 74 is secured to base plate 22 and the lower surface of lower bellow 80 is secured to the bottom plate 14. As in the case of the bellows 60, 62 and 64, a regulated supply of air is provided to the bellows 74, 76, 78 and 80 from air compressor 68 through a regulator 82. The regulated air pressure, supplied to the bellows 74, 76, 78, and 80 is such that it permits wobbling of the base plate 22, and does not tend to lift the base plate 22, such that it would not be fully supported by the bellows 60, 62 and 64. Should it be desirable to reduce the air pressure in bellows 74, 76, 78, and 80, air may be discharged through valve 84. Not only do the bellows 74, 76, 78, and 80 prevent the inner crushing member 20 from turning, but they also provide a seal to prevent crushed material, and dust therefrom, from reaching the bearings 38 and 66. Similarly, bellows 58 further prevents the crushed material and dust from reaching the upper surface of bearing 54.

The shaft 50 is provided with a splinted bore 86 which receives an externally splined shaft 88. The shaft 88 is held in a fixed vertical position by an increased diameter portion 90, the lower edge of which rests on the inner race 92 of a bearing assembly 94. Outer race 96, of the bearing assembly 94, is secured to a support bracket 98 by clamps 100 and fasteners 102. Attached to the lower end of the shaft 88 is a pulley 104. The pulley 104 is driven by a belt 106 which engages a pulley 108 driven by a prime mover 110, such as an electric motor. While a pulley and belt drive system is shown, other types of drive systems could be used, such as a hydraulic drive or a conventional gear and pinion shaft drive. Bearing assembly 94 can also be a horizontally or vertically disposed roller, sleeve or thrust bearing system.

The outer crushing member 18 is supported from the bottom plate 14 by a cylindrical wall member 112 which is welded at its lower end 114 to the bottom plate 14 and is provided with a flange 116 at the top. The flange 116 is provided with apertures 118 therein, located to coincide with apertures formed in the upper crushing member 18, to receive bolts such as 120 to secure the upper crushing member 18 to the cylindrical wall 112.

Turning to the operation of the crusher, material to be crushed is deposited in a hopper 122 through which it enters into a conical gap 124 between the outer crushing member 18 and the inner crushing member 20. As the inner crushing member 20 wobbles within the outer crushing member 18, the material falls in the area where the crushing members are more widely spaced and is thereafter crushed as the inner and outer members move together. By increasing the air pressure in bellows 60, 62, and 64, the inner crushing member 20 may be raised, moving its outer surface closer to the outer crushing member 18, thereby resulting in finer crushing of the material being crushed.

While in heavier duty crushers such as those set forth in the above-mentioned patents, replaceable wear members, usually called liners, are provided on the inner and outer crushing parts, in the conical crusher of this invention, the replaceable wear liners are not provided. However, members 18 and 20 can be replaced when worn. Rather, the inner crushing member or mantle and the outer or upper crushing member are formed of a suitable wear resistant material. Suitable materials for particular applications are manganese, air quenched and tempered chromium steel, and a low cost steel with wear resistant studs provided on the crushing surface. While the inner crushing member or mantle 20 and the outer crushing member 18 may be made of suitable wear resistant material, their strength may not be sufficient to prevent deformation in certain applications. To prevent deformation, the outer crushing member 18 may be provided with ribs. Or, a separate rib cage including ribs 126 (shown in FIG. 4) may be provided and can be secured over the outer crushing member 18. Similarly, a rib cage 128, as shown in FIG. 5, may be provided to fit under the mantle or inner crushing member 20 so as to reinforce it.

Referring to FIG. 2*a*, in an alternate embodiment of this invention the air bellow assembly 58 supporting the inner crushing member 20 on the bottom plate 14 is replaced by several hydraulic cylinders, one of which 136 is shown. Hydraulic pressure is supplied to the cylinders by a pump 138. To provide the bearing 54 with the same protection from crushed material and dust as is provided by the bellows 58, a flexible cylindrical wall 140 is secured to the bottom surface of lower cylindrical member 32 and bottom plate 14.

Bellow assembly 58 and air bellows 74, 76, 78, and 80 can be replaced by other support devices. System parameters and design criteria can affect the embodiment of either support device. For example, the support device between base plate 22 and bottom plate 14 preferably provides sufficient force to counteract crushing forces and yet does not substantially lift plate 22 with respect to plate 14. The support device allows wobbling of inner crushing member 20 and yet prevents inner crushing member 20 from turning. The support device preferably also seals bearing 38 from the crushed material in crusher 10. The support device can be a spring assembly, a cable tension assembly, a piston assembly, or other apparatus for providing an appropriate level of tension and force between member 20 and bottom plate 14.

To prolong the life of the bearings 38, 54, 66, and 94, a lubrication system 130 is provided whereby lubrication may be supplied to the bearings While the rusher is in operation. The lubrication system includes a pressurized source of lubricant 132, and a piping system 134 connecting each of the bearings to the source 132.

When comparing a conical crusher constructed in accordance with this invention as set forth above, with those shown in the prior art patents set forth above, it will be noted that the following advantages are offered:

1. Fewer parts.
2. Simplified manufacturing and fabrication.
3. Lower cost.
4. Increase energy efficiency.
5. Will operate with the material to be crushed being either wet or dry.
6. Lower operating cost per ton of product crushed.
7. Better quality control of the ground product through the ready adjustment provided by the bellows support system for the inner crushing member.
8. Ease of operation, maintenance and repair.

For instance, while replaceable liners are not provided, worn inner and outer crushing members can be readily replaced wherein they are attached to the crusher by readily engageable and disengageable fastening means shown as nuts and bolts.

It should be noted that if tramp material becomes wedged between the inner and outer grinding members, the air pressure in the bellows supporting the inner grinding member may be reduced, thereby permitting the inner grinding member to drop away from the outer grinding member so as to free the tramp material from between the grinding surfaces. Since the crushing gap between the inner and outer members is readily adjusted and controlled by the bellows support system, the particle size of the crushed material may be readily adjusted.

While one embodiment, and component variations of the invention have been shown, it should be apparent to those skilled in the art that what has been described is considered at present to be a preferred embodiment of the conical crusher of this invention. In accordance with the Patent Statute, changes may be made in the conical crusher without actually departing from the true spirit and scope of this invention. The appended claims are intended to cover all such changes and modification which fall in the true spirit and scope of this invention.

What is claimed is:

1. A crusher, comprising:

a main support member;

a gyrational mechanism supported by said main support member, said gyrational mechanism providing a gyrational motion with respect to said main support member;

a crushing member indirectly or directly mechanically coupled to said gyrational mechanism, said crushing member performing a crushing motion in response to the gyrational motion; and a fluid bellow assembly secured between said crushing member and said main support member, said fluid bellow assembly containing fluid at a pressure to support said crushing member with respect to said main member, said pressure being regulated to adjust a position of said crushing member with respect to said main member.

2. The crusher of claim 1, wherein said fluid bellow assembly is an air bellow assembly.

3. The crusher of claim 2, wherein said crushing member includes a conically shaped head and a base plate, the base plate being secured to a bottom of the head and to said gyrational mechanism.

4. The crusher of claim 1, wherein said gyrational mechanism includes a plurality of bearing rollers, a central axis of the bearing rollers being not parallel to a central axis of the crusher.

5. The crusher of claim 2, wherein said air bellow assembly is formed with one concentric generally cylindrical wall and ring shaped top and bottom members, said air bellow assembly being generally concentric with said crushing head and surrounding at least a portion of said gyrational mechanism.

6. The crusher of claim 2, wherein said air bellow assembly is formed of two or more air bellows stacked one on top of the other between said main support member and said gyrational mechanism.

7. The crusher of claim 1, further comprising:

an outside bellow assembly secured to said crushing member and said main support member, said outside bellow assembly surrounding at least a portion of said gyrational mechanism, said outside bellow assembly preventing rotation of said crushing member with respect to said main support member.

8. The crusher of claim 7, wherein said outside bellow assembly is formed with one concentric generally cylindrical wall and ring shaped top and bottom members.

9. The crusher of claim 8, wherein apertures are provided in said main support member in locations radially outward, with respect to said shaft, from the outside bellow assembly, through which material crushed in said crusher may fall below said main support member.

10. The crusher of claim 7, wherein said outside bellow assembly is formed of two or more similar air bellows stacked on top of the other.

11. The crusher of claim 10, wherein the gyrational mechanism includes a lower member, an upper member, and a ring bearing assembly including a lower bearing race and an upper bearing race with bearings interposed therebetween, said lower bearing race being supported by said fluid bellow assembly, and said upper bearing race supporting said lower member, so as to provide for rotation of said lower member with respect to said fluid bellow assembly and said main support member.

12. The crusher of claim 7, including an air compressor for supplying compressed air to said fluid bellow assembly and said outside bellow assembly.

13. The crusher of claim 12, including means to regulate the supply of compressed air from said air compressor, to said fluid bellow assembly to adjust a crushing gap associated with said crushing member.

14. The crusher of claim 12, wherein said compressed air from said air compressor is provided to said outside bellow assembly so as to provide a desired degree of firmness of said outside bellow assembly to prevent rotation of said crushing member with respect to said main support member.

15. A crusher mounted on a foundation, said crusher comprising:

a main support member secured to the foundation, said main support member having at least one aperture therein, a wobble mechanism comprising a lower member and an upper member, each of said members having top and bottom surfaces, said upper member supported for rotation with reference to said lower member by a first bearing assembly located between the top surface of said lower member and said bottom surface of said upper member, said lower member located above said main support member and adjustable spaced therefrom by a first adjustable support assembly, a shaft passing through said aperture in said main support member, said lower member secured to said shaft, such that rotation of said shaft causes rotation of said lower member with respect to said main support member, a second bearing assembly located between said first adjustable support assembly and said lower member to permit rotation of said lower member with respect to said first adjustable support assembly, said top and bottom surfaces of said lower member not being parallel to each other, such that rotation of said lower member with respect to said upper member causes said upper member to wobble, a bottom plate secured to said top surface of said upper member, an air bellow assembly secured to said bottom plate and to said main support member, said air bellows preventing the rotation of said bottom plate with respect to said main support member, a conically shaped, downwardly spreading, inner crushing member supported on said bottom plate, a frustoconically shaped, downwardly spreading, outer crushing member supported on said main support member in a spaced relationship to said conically shaped inner crushing member, whereby when the spacing of said lower member from said main support member is adjusted by said first adjustable support assembly, the spacing between said inner crushing member and said outer crushing member is adjusted, the spacing being decreased by increasing the spacing between said lower member and said main support member, such that material passing between said inner crushing member and said outer crushing member, as the inner crushing member wobbles with respect to said outer crushing member, is more finely crushed.

16. The crusher of claim 15, wherein said first adjustably support assembly includes hydraulic cylinders or a fluid bellow device.

17. A crusher comprising:

a main frame;

a crushing member; and a wobble mechanism having a first member, a second member, and an adjustable support member, said first member being supported for relative rotation with respect to said second member, said second member being secured to said crushing member, said second member being adjustably spaced from said main frame by said adjustable support member, wherein the adjustable support member is a fluid bellow assembly, whereby a spacing between the second member and the main frame can be adjusted to define the size of crushed material provided by said crusher.

18. The crusher of claim 17 wherein the adjustable support member is an air bellow assembly.

19. The crusher of claim 19 wherein the fluid bellow assembly includes a fluid, and the fluid is pressurized air.

20. The crusher of claim 17 wherein the adjustable support member is comprised of separate air bellows.

21. A crusher comprising:

a main support member;

a wobble mechanism rotatably coupled to the main support member, the wobble mechanism providing mechanical motion;

a crushing member coupled to receive the mechanical motion from the wobble mechanism, the crushing member performing a crushing motion in response to the mechanical motion; and an adjustable bellow support means for supporting the wobble mechanism and positioning the wobble mechanism with respect to the main support member, the wobble mechanism being positioned to define a size of crushed material formed by the crushing motion.

22. The crusher of claim 21, further comprising:

an auxiliary support means for supporting the crushing member and preventing the crushing member from rotating during the crushing motion.

23. The crusher of claim 22, wherein the auxiliary support means is a hydraulic cylinder, food bellow, cable assembly, spring assembly, or piston mechanism coupled between the crushing member and the main support member.

* * * * *